US005183513A

United States Patent [19]

Sajewski

[11] Patent Number: 5,183,513

[45] Date of Patent: Feb. 2, 1993

[54] METHOD OF CLEANING INTERNAL SURFACES UTILIZING CAVITATING FLUID

[75] Inventor: Ronald Sajewski, Rochester, Mich.

[73] Assignee: Applied Hydro Dynamics, Inc., Rochester, Mich.

[21] Appl. No.: 698,157

[22] Filed: May 10, 1991

[51] Int. Cl.[5] ..... B08B 9/093

[52] U.S. Cl. ..... 134/22.12; 134/18; 134/22.18; 134/24; 134/25.2

[58] Field of Search ..... 134/22.12, 22.14, 22.18, 134/24, 34, 37, 18, 25.2

[56] References Cited

U.S. PATENT DOCUMENTS

| | | | |
|---|---|---|---|
| 1,840,834 | 1/1932 | Davis, Jr. | 134/22.12 |
| 3,457,108 | 7/1969 | Hittel | 134/22.18 |
| 4,226,642 | 10/1980 | Baran | 134/37 |
| 4,756,770 | 7/1988 | Weems et al. | 134/22.18 |
| 4,773,357 | 9/1988 | Scharton et al. | 134/22.18 |

FOREIGN PATENT DOCUMENTS

| | | | |
|---|---|---|---|
| 0391057 | 7/1973 | U.S.S.R. | 134/22.18 |
| 0597443 | 3/1978 | U.S.S.R. | 134/22.18 |

*Primary Examiner*—Theodore Morris
*Assistant Examiner*—Saeed Chaudhry
*Attorney, Agent, or Firm*—Dykema Gossett

[57] ABSTRACT

A unique cleaning method and structure is disclosed which pulses pressurized fluid into a vessel. The pulses clean internal surfaces within the vessel. The internal surfaces may include the internal surfaces of the vessel, or may include items to be cleaned which are placed within the vessel. The pulsed fluid preferably cavitates within the vessel, and impacts upon the surfaces to be cleaned, removing impurities such as scale or other buildup. The fluid may then be directed downstream and recirculated back through the system. Pulses of fluid are cyclically controlled by a control valve to optimize the amount of cavitation within the vessel.

19 Claims, 8 Drawing Sheets

METHOD OF CLEANING INTERNAL SURFACES UTILIZING CAVITATING FLUID

BACKGROUND OF THE INVENTION

The present invention relates to a method of cleaning surfaces within a vessel utilizing cavitation of a pulsating pressurized fluid.

It has been a problem in the prior art to develop a system which efficiently and effectively cleans surfaces within various types of fluid vessels. Vessels such as heat exchangers, condensors, filters, pipes, automotive components such as radiators or engines, and other types of fluid vessels may develop scale deposits or other materials on interior flow surfaces. It is desirable to remove that scale from those surfaces. Further, various types of cleaning systems are known for cleaning smaller items within an enclosed vessel. These types of systems include dish or clothes washing systems.

It is an object of the present invention to develop a system which utilizes pulses of fluid to clean internal surfaces of vessels, or items within an enclosed vessel. It is further an object of the present invention to disclose a system which can be easily modified to clean various types of fluid vessels and items.

SUMMARY OF THE INVENTION

In a disclosed embodiment of the present invention a fluid is pulsed into a vessel, and the pulsed fluid impacts upon a surface within the vessel. The impact of the pulsed fluid on the surface removes incrustation, scale or other impurities from the surface. The internal surface to be cleaned can be the interior of the fluid vessel, if the fluid vessel is normally used for other fluid purposes, or could be items placed inside the fluid vessel for cleaning.

In a preferred embodiment of the present invention, the fluid system may be attached to a fluid vessel which is normally used for other flow applications. The system is attached as a cleaning system, and only for the temporary period that the vessel is being cleaned. On-off valves may be connected to flow passages leading into and out of the fluid vessel to facilitate the connection of the system to the particular fluid vessel. Among disclosed embodiments for this type of use are cleaning a heat exchanger, a condensor, a fluid filter, a pipe section, the cooling and heating sections of an automobile engine, and an automobile radiator. Other vessels may be cleaned within the scope of this invention.

In other embodiments of the present invention the system is connected to a closed cleaning vessel which contains items to be cleaned. Among the disclosed items cleaned under these embodiments of the invention are medical instruments, dishes and clothes. Other items may be cleaned within the scope of this invention.

In a preferred embodiment of the present invention the fluid system is operated such that the pressure and timing of the fluid pulses entering the vessels is selected and controlled so that the fluid cavitates within the vessel. This cavitation impacts upon the surfaces to be cleaned and removes deposits, scale and other buildup, greatly enhancing the cleaning efficiency of the fluid.

Cavitation is an occurrence which is preferably avoided in most fluid operations. Cavitation is the formation of bubbles within a fluid when that fluid reaches its vapor pressure. The vapor pressure is dependent on the fluid temperature, and when a fluid reaches a particular vapor pressure for a particular temperature, bubbles form within the fluid. When those bubbles contact a surface, such as a metal surface, they implode. Over time the implosion of the bubbles can pit or damage metal surfaces. Thus, cavitation is typically avoided in prior art fluid systems. A main feature of the present invention is the realization that cavitation can be used for beneficial purposes. In particular, a pulsating fluid directed into a vessel at such frequency, pressures and temperatures that it cavitates within the vessel, removes build-up from internal surfaces, and efficiently cleans those surfaces.

In another feature of the present invention, the frequency and pressure of the pulsed fluids is controlled to achieve optimum cavitation within the vessel. A preferred cyclic frequency and pressure is determined experimentally using a model of the vessel to be cleaned.

In a preferred embodiment of the present invention, a pump delivers pressurized fluid to a cyclically opened and closed control valve upstream of the vessel, the valve creates the pulses. A cushion is disposed between the pump and the valve to absorb fluid hammers when the valve is closed.

A feedback sensor is preferably disposed between the valve and the vessel to sense the frequency and intensity of the pressure pulses passed from the valve towards the vessel. This feedback is directed to a controller for the valve, assuring the valve is operating as desired. The controller preferably ensures that the valve operates at the preferred cyclic frequency.

Further objects and features of the present invention can be best understood from the following specification and drawings, of which the following is a brief description.

DETAILED DESCRIPTION OF A PREFERRED EMBODIMENT

Figure 1:
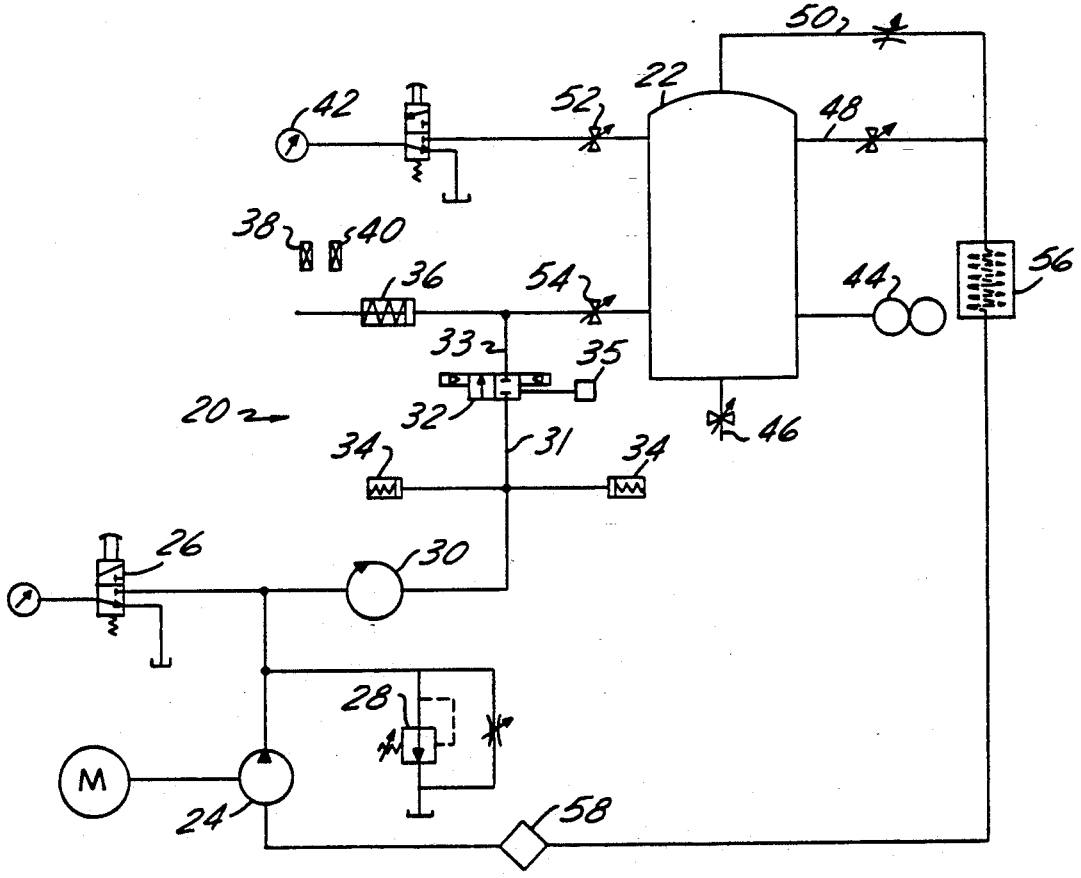
FIG. 1 is a largely schematic view of a fluid system which may be utilized as a cleaning system.

FIG. 1 is a largely schematic view of a generic fluid system 20 which is modified to perform various functions. Co-pending application 07/698,545 describes the system being used to generate heat. Fluid vessel 22 is disposed within circuit 20, and may be any one of a number of types of fluid vessels. In the present invention, fluid vessel 22 is cleaned by the fluid system 20.

Pump 24 delivers pressurized fluid to downstream locations. Bypass valve 26 and pressure regulator valve 28 are disposed upstream of pump 24. Flow meter 30 monitors the amount of fluid flowing from pump 24 into line 31, downstream of flow meter 30. Fluid from line 31 is directed into a cyclically operating control valve 32, which opens and closes to allow fluid pulses to move from line 31 to line 33. A controller 35, shown schematically, operates to open and close valve 32.

When valve 32 is closed, a pressure hammer may be directed back upstream along line 31. "Cellular plastic cushions" 34 absorb these hammers. In one preferred embodiment, cushions 34 consisting of a steel pipe (cylinder) enclosed at one end and filled with rigid plastic, remote from line 31, but opening into line 31. The foam is tightly received within the closed end of the pipe (cylinder) such that the pressure hammer moves into cushion 34 and compresses the foam, which absorbs the hammer.

When valve 32 is open a pressure pulse is directed into line 33. A pressure wave sensor 36 monitors the frequency and intensity of these pulses. Pressure sensor 38 and vacuum sensor 40 monitor the position of a piston, disclosed below, within pressure wave sensor 36 and give an indication to controller 35 for valve 32 of the actual intensity and frequency of the pulses in line 33.

Pulses in line 33 are directed into fluid vessel 22. Fluid vessel 22 is preferably flooded prior to application of these pulses. Preferably, the intensity frequency and pressure of the fluid pulses directed into vessel 22 are controlled such that the pulses cavitate upon being exposed to the relatively large volume vessel 22. Cavitation may occur when a fluid is exposed to an environment at which it moves to the vapor pressure for its temperature. As an example, a highly pressurized fluid suddenly being exposed to a larger area creates cavitation, if conditions are closely controlled. Further, the rapid pressure changes between high pressure and vacuum as valve 32 opens and closes may cause cavitation. The cavitation of the fluid within vessel 22 cleans internal surfaces within vessel 22.

Pressure indicator 42 is disposed on a line communicating with pressure vessel 22. Thermal well 44 taps heat from the interior of vessel 22, which may be used for beneficial purposes. Drain line 46 may communicate to fluid vessel 22, and may allow draining of fluid when cleaning vessel 22. Outlet lines 48 and 50 lead from vessel 22. Line 50 may be utilized to vent entrapped gas from vessel 22. Line 48 includes a selectively open valve while line 50 includes a relief valve. A selectively open valve 52 is on the line leading to pressure indicator 42. A selectively open valve 54 is disposed between line 33 and vessel 22. By closing valves 52, 54 and the valve on line 48, one isolates vessel 22 from the remainder of the pressurized system. This is done when it is desired to disconnect vessel 22 from system 20. Member 56 mounted downstream of outlet line 48 may include a filter or heat exchange structure, as will be explained below. A line from member 56 leads into sump 58 which returns the fluid back to pump 24.

Figure 2:
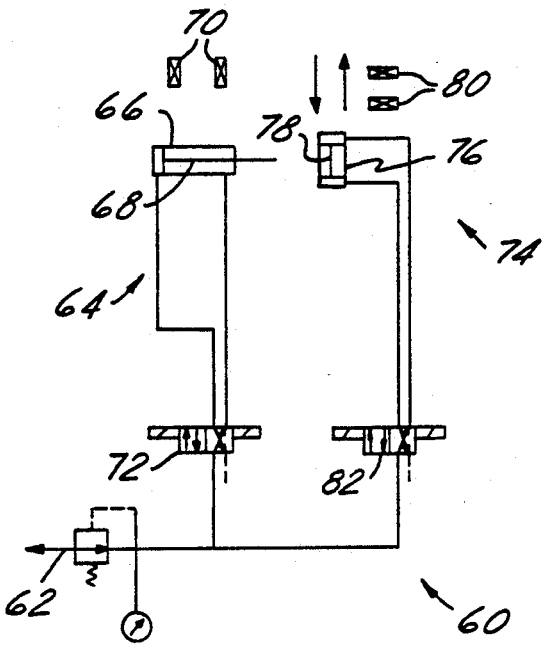
FIG. 2 is a schematic of a hydraulic control for a control valve incorporated in the system of FIG. 1.

FIG. 2 discloses hydraulic control circuit 60 for valve 32. Line 62 leads from a source of pressurized fluid. Lock circuit portion 64 includes lock cylinder 66 receiving piston 68. Sensors 70 detect the position of piston 68. Valve 72 directs fluid to opposed ends of cylinder 66 to retract or extend piston 68. Piston 68 may lock valve 32 in either an open or closed position. The lock circuit is typically left open during operation of system 20.

Cyclic circuit portion 74 is utilized for the cyclic operation of valve 32. Cylinder 76 receives piston 78 and sensors 80 detect the position of piston 78. Valve 82 directs fluid to the opposed end of piston 78 to move it between open and closed positions, as will be explained below. Controller 35 controls the operation of valve 82.

Figure 3B:
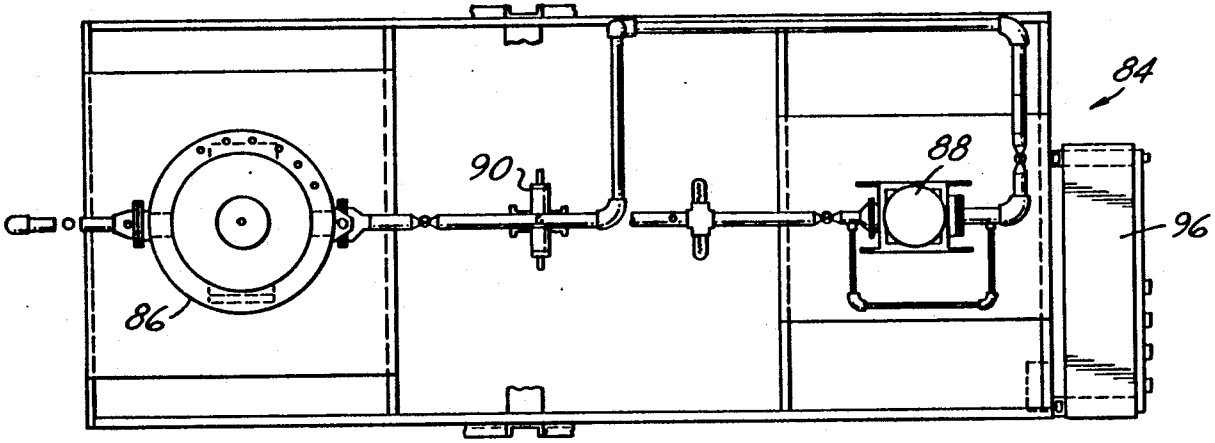
FIG. 3B is a top view of the test rig shown in FIG. 3A.
Figure 3A:
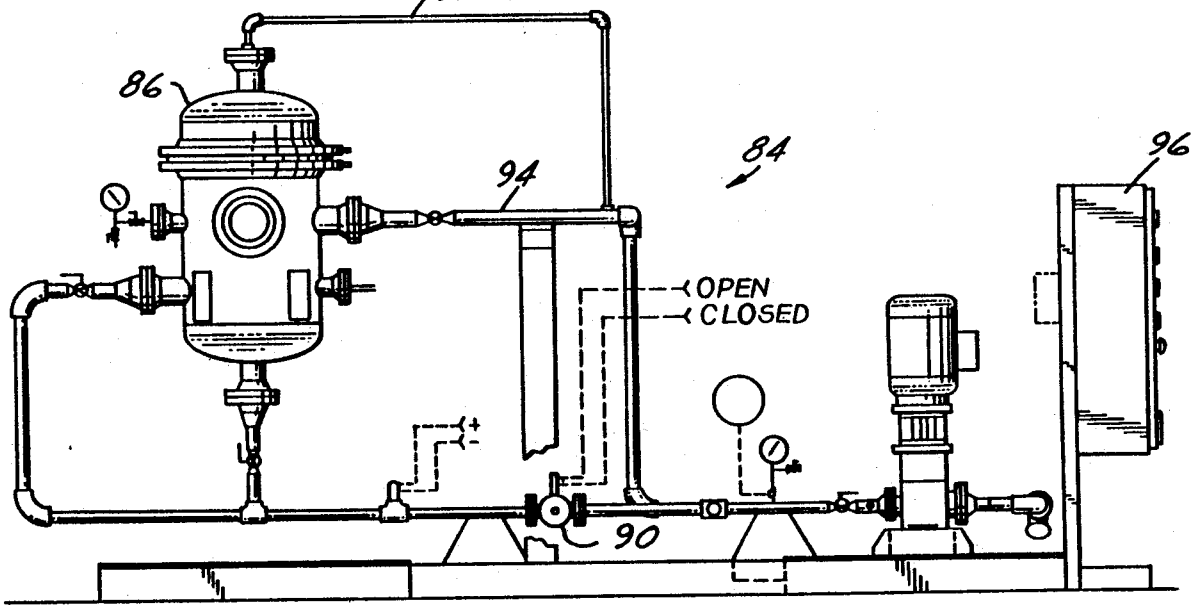
FIG. 3A is a side view of a test rig for developing preferred operating characteristics.

FIG. 3A shows test rig 84 for determining preferred cyclic frequency and pressures for the fluid pulse flow through valve 32. Test rig 84 includes experimental vessel 86 which is modeled to approximate a vessel to be used with system 20. Vessel 86 receives fluid from pump 88. Fluid from pump 88 passes through the cyclical control valve 90 which is connected to a computer control. Outlet lines 92 and 94 return fluid back to a sump for pump 88. Control 96 is used to vary frequency and pressure of the fluid pulses passing into vessel 86 to experimentally determine optimized cyclic frequencies and pressures for the fluid. The frequency and pressures are selected to achieve optimum cavitation, cleaning and efficient operation. The data generated by utilizing experimental test rig 84 may be incorporated into a dedicated controller 35 for an actual circuit 20.

FIG. 3B is a top view of test rig 84. Vessel 86 is mounted downstream of valve 90 which is downstream of pump 88.

Figure 4A:
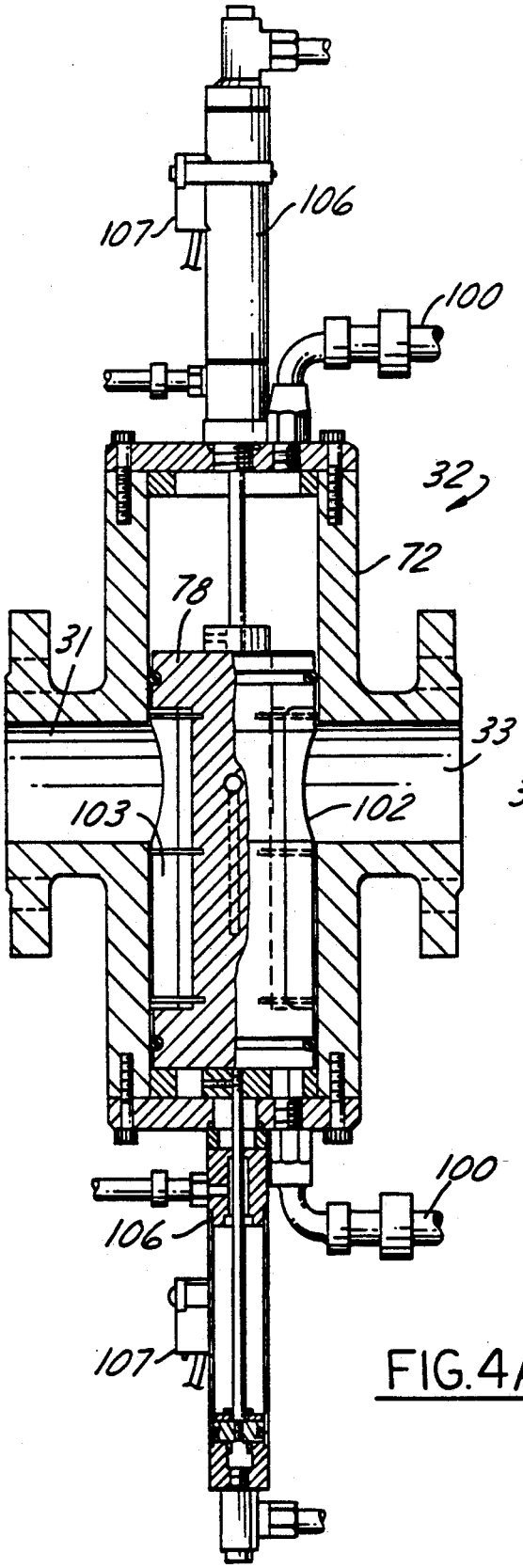
FIG. 4A is a view of a control valve in an open position.

Valve 32 will now be explained with reference to FIGS. 4 and 5. FIG. 4A illustrates valve 32 including cylinder 72 which receives piston 78, which is preferably stainless steel, although other materials may be used. Piston 78 is shown in an open position allowing fluid from line 31 to pass through opening 102 to line 33. Opening 102 is preferably the same diameter as both lines 31 and 33 to eliminate and restriction on the flow line. Pressurized fluid is directed through lines 100 into pressure chambers on opposed sides of piston 78 to move it between the open position illustrated in FIG. 4A, and a closed position illustrated in FIG. 4B. A teflon sleeve 103 is mounted on piston 78 where it contacts the interior of cylinder 72 to prevent fluid leakage, wear and to facilitate sliding movement of piston 78. Cushions 106 are mounted at locations spaced from the pressure chambers receiving fluid 100, to absorb the shock from rapid movement of piston 78 between open and closed positions. Electromagnetic detents 107 detect the position of a piston within cushion 106.

Figure 4B:
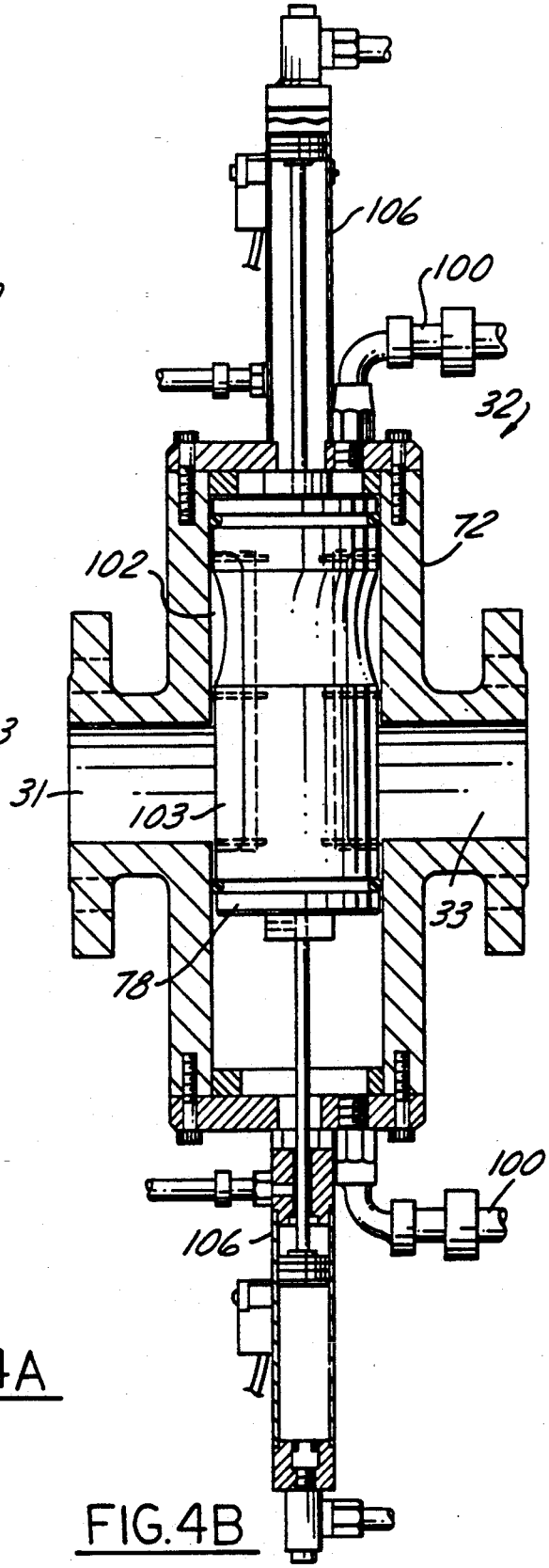
FIG. 4B is a view of the valve shown in FIG. 4A in a closed position.

As shown in FIG. 4B, piston 78 has been moved to the closed position. Shield 103 now blocks fluid flow between line 31 and 33.

Figure 5B:
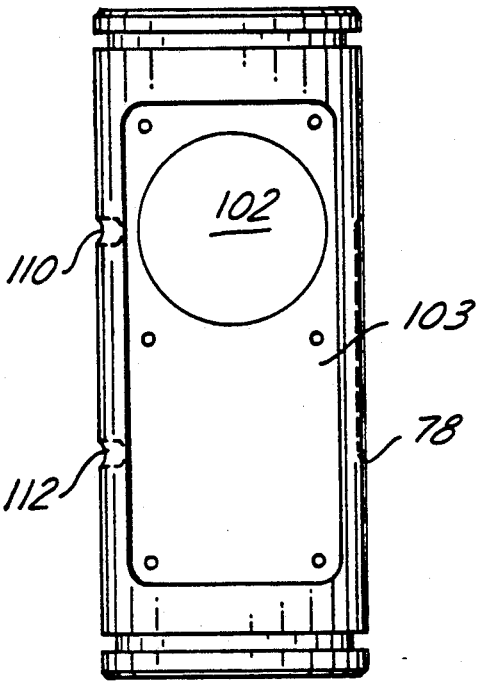
FIG. 5B is a front view of the valve shown in FIG. 5A.
Figure 5A:
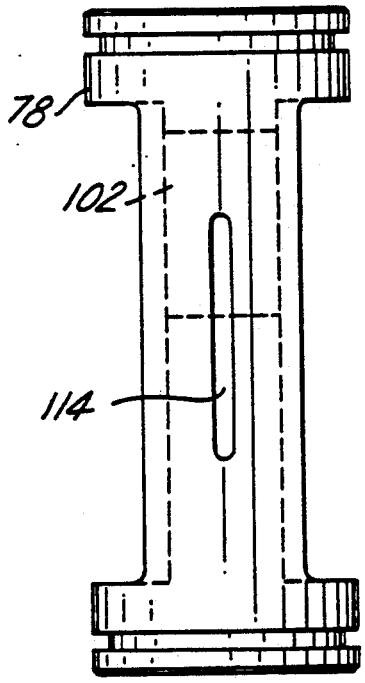
FIG. 5A is a side view of a valve body according to the present invention.

FIG. 5A illustrates the side of piston 78. Line 102 passes through valve 72. Guide slot 114 is formed in the side of valve 78 and receives a spring-biased ball, not shown, that is mounted within cylinder 72, to ensure that the movement of piston 78 relative to 72 is along an intended direction.

FIG. 5B shows locking holes 110 and 112 at spaced axial locations on piston 78. Line 102 passes directly through piston 78. Teflon shield 103 surrounds the area of fluid line 102.

Figure 5C:
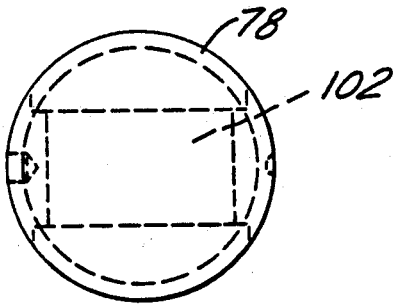
FIG. 5C is an end view of the valve shown in FIG. 5A.

FIG. 5C is a top view of piston 78. Line 102 passes through its entire extent.

Figure 5D:
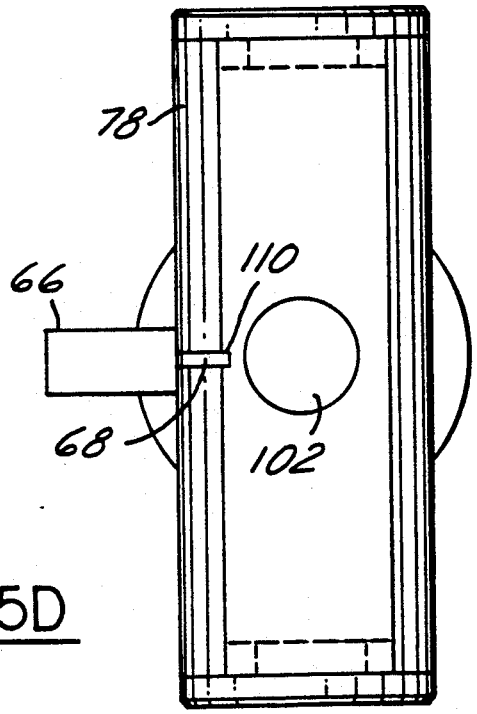
FIG. 5D is a largely schematic view of the valve shown in FIG. 5A, and further illustrating a locking feature according to the present invention.

FIG. 5D shows locking piston 118 in hole 110. This locks piston 78 at a position where line 102 is open and allows fluid flow between line 31 and 33. During normal cyclic movement of valve 32, piston 78 would not be locked. There may be occasion when it is desired to lock piston 78 at a particular location, however, and cylinder 116 can lock piston 78 at either the opened or closed positions. The controller for valve 32 receives a feedback signal from locking piston 118.

Figure 6:
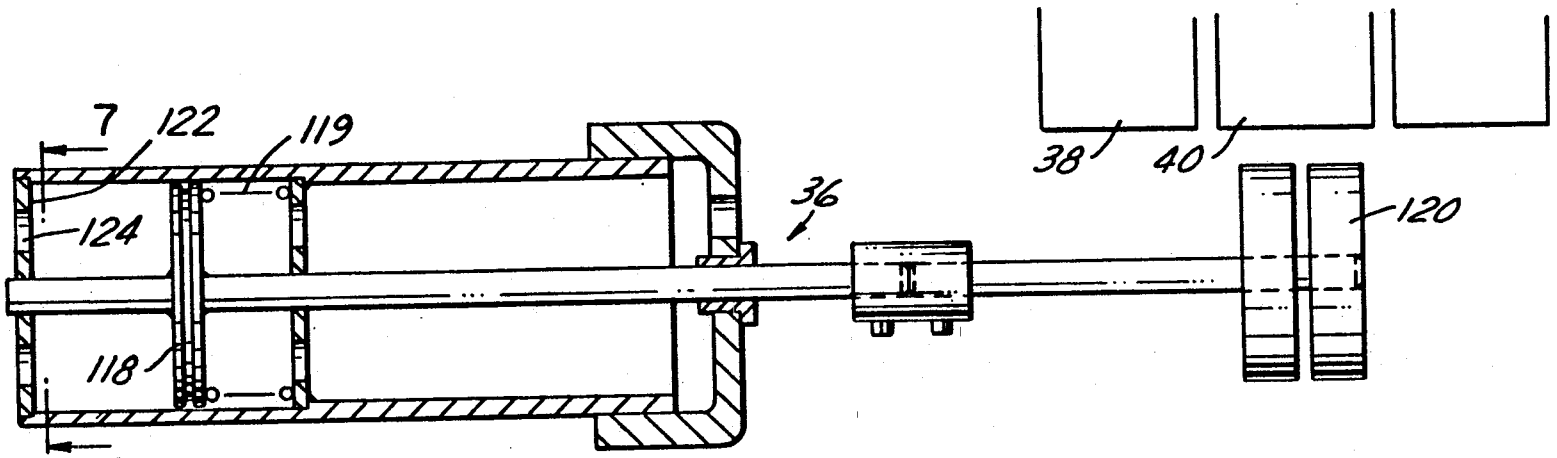
FIG. 6 is a view of a feedback member utilized with the present invention.

FIG. 6 shows details of pressure wave sensor 36. Spring 119 biases piston 118 and piston end 120 away from sensors 38 and 40. Closure member 122 is mounted on an end of pressure wave sensor 36 which faces line 33. Openings 124 pass through closure member 122. When valve 32 is closed a vacuum is drawn on line 33, and spring 120 forces piston 120 to the left as shown in this figure. Sensor 38 identifies that a vacuum exists on line 33. When a pressure pulse is directed on line 33, the pulse will force piston 120 to compress spring 118 and move towards the position illustrated in FIG. 6. Sensor 40 then determines that a pressure pulse is applied on line 33. Sensors 38 and 40 send this information to controller 35 for valve 32.

Figure 7:
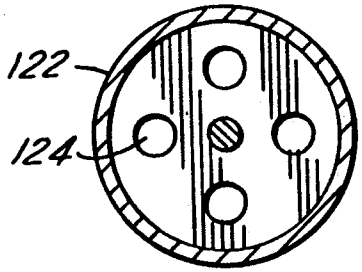
FIG. 7 is a view along line 7—7 as shown in FIG. 6.

FIG. 7 is an end view of closure 122. A plurality of fluid ports 124 pass through closure 122.

Figure 8:
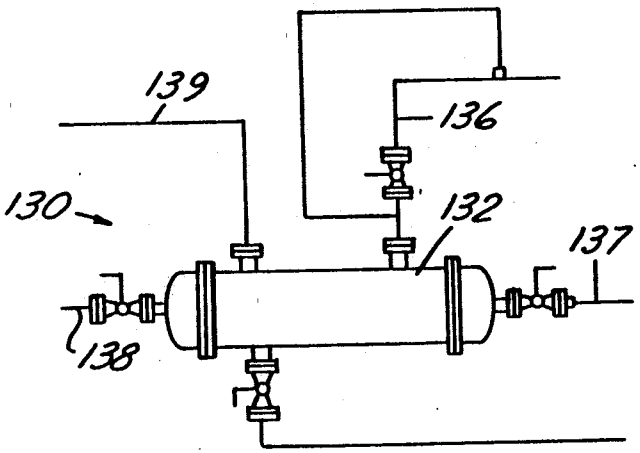
FIG. 8 is a partially schematic view of a condensor which is cleaned by the system of the present invention.

FIG. 8 discloses condensor 130 including a condensor chamber 132 which receives a process or exchange fluid 134 and directs that fluid to an outlet 136. The refrigerant or working fluid enters chamber 132 through line 137 and exits through line 138. In the method of the present invention a system similar to that illustrated in FIG. 1 is attached between inlet 134 and outlet 136 to clean the flow lines and heat exchange chamber for this fluid. The flow passages for the refrigerant or working fluid typically remain clean since that fluid is sealed within the refrigerant system. A feedback line 139 to monitor conditions within condensor 132 may be connected to controller 35 for the system illustrated in FIG. 1.

When it is desired to clean condensor 130 on-off valves on lines 134 and 136 are closed and the normal fluid connections to those lines are disconnected. The system illustrated in FIG. 1 is then connected to lines 134 and 137, the on-off valves are opened. The vessel is flooded and pulses of fluid are then directed into chamber 132. The pulses impact upon the surfaces within chamber 132 and remove scale and other impurities within the chamber. The fluid is directed outwardly of line 136 and back to the sump. Alternatively, the outlet line 136 may lead directly to a drain.

Figure 9:
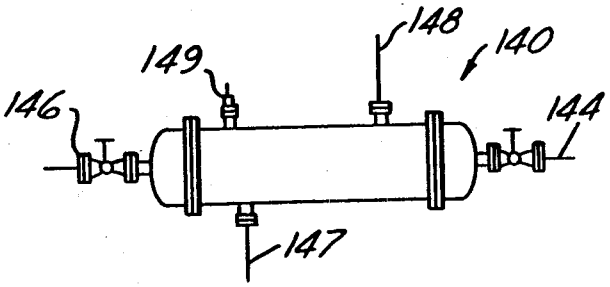
FIG. 9 is a partially schematic view of a heat exchanger which is cleaned by the system of the present invention.

FIG. 9 shows a system for cleaning heat exchanger 140. Heat exchanger 140 contains a body 142 which receives a process or service fluid from an inlet line 144. This is the fluid that is to be heated within heat exchanger 140. The fluid is heated within chamber 142 and leaves through outlet 146. A steam inlet line 147 leads into an outer jacket in chamber 142, and is directed out of chamber 142 through an outlet line 148. The steam lines 147 and 148 and their outer jacket may not need to be cleaned with the method of the present invention since they will tend to be relatively clean surfaces. In this embodiment the process or service fluid lines and the inner jacket of chamber 142 are cleaned by the pulses of fluid. Feedback line 149 may also be disposed on chamber 142.

When it is desired to clean heat exchanger 140, on-off valves on lines 144 and 146 are closed and the normal fluid connections are disconnected. System 20 is then connected between lines 144 and 146 the on-off valves are opened, and pulses of fluid are directed into chamber 142. Those pulses clean surfaces within chamber 142 and the fluid is directed outwardly of line 146.

Figure 10:
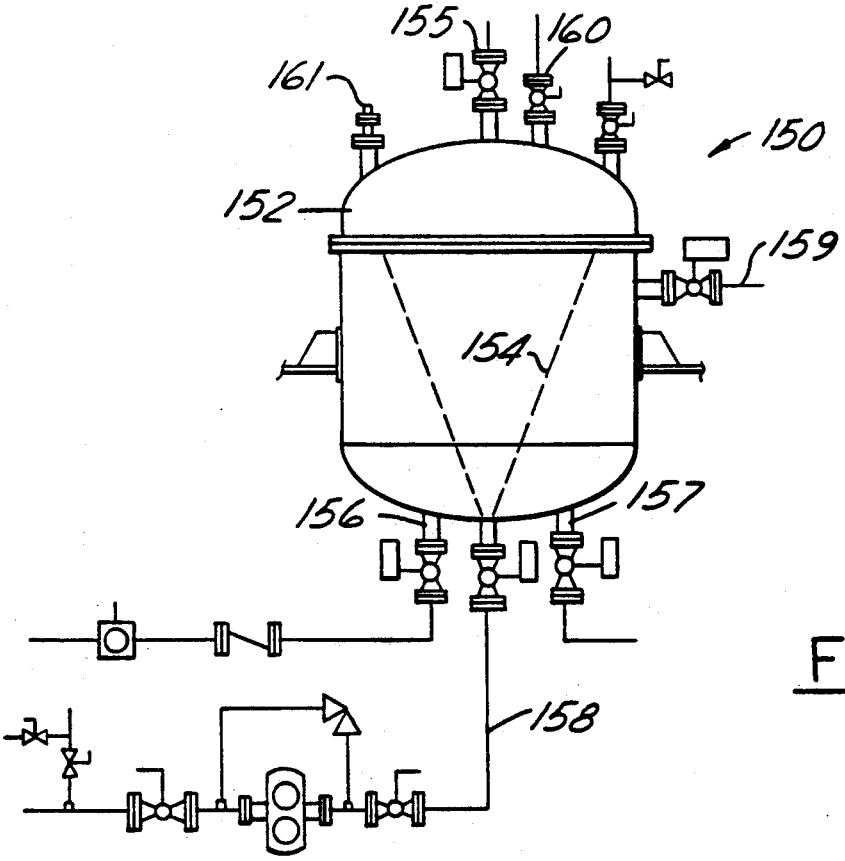
FIG. 10 is a partially schematic view of a filter which is cleaned by the system of the present invention.

FIG. 10 illustrates a method for cleaning filter 150, which includes filter chamber 152 and conical filter member 154. Under normal conditions a fluid to be filtered enters line 155, passes through conical filter 154 and outlets through line 156. In the method of the present invention, system 20 is connected to line 157 and directs pulses of fluid into filter chamber 152 such that roiling fluid generated from cavitation pulses onto the surfaces of conical member 154 which is normally downstream. Clean fluid within the outer filter chamber is directed outwardly of line 159. Portions of the fluid directed into line 157 will pass through conical filter member 154 and remove built-up materials. A valve on a drain line 158 is opened and this fluid including these removed materials, which could be called a sludge, drains through line 158. A sludge pump may be mounted downstream of line 158 to assist in this removal. A line 160 serves as an air vent during this cleaning operation. A feedback line 161 may also be mounted on filter body 152.

When it is desired to clean filter 150, the system illustrated in FIG. 1 is connected between lines 157 and 159. Filter chamber 152 is flooded and pulsed or roiling fluid enters the outer body of filter chamber 152 and removes sludge and other sediment from filter member 154. That sludge then drain through line 158.

Figure 11:
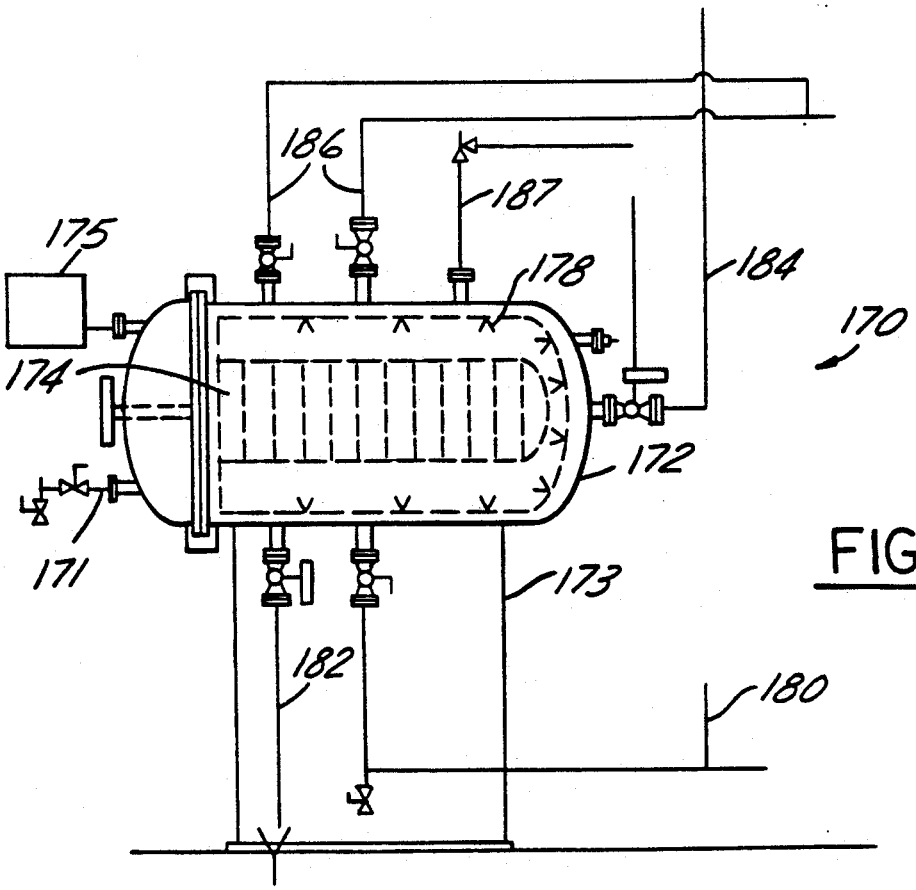
FIG. 11 is a partially schematic view of a medical instrument washer which utilizes the system of the present invention.

A medical instrument washer 170 is illustrated in FIG. 11. A container 172 is mounted on a base 173. A member 174 for holding a plurality of medical instruments is shown schematically. The details of the holder member 174 form no part of this invention An inlet line 176 is connected into the interior of body 172. Additives may be added into line 176 through line 180, and could include appropriate disinfectants.

Drain line 182 leads outwardly of chamber 172, and a hot water rinse line 184 leads to a plurality of nozzles 178 which lead to the interior of chamber 172. Lines 186 are the normal outlet lines for system 20 illustrated in FIG. 1. Relief line 187 may be included. A pressure indicator 171 and a thermal well 175 are both used for feedback. If thermal well 175 detects undesirably high temperatures it can shut off the system.

The inventive method as applied to the medical instrument washer 170 illustrated in FIG. 11 includes directing pulses of fluid in line 176, which may include entrained additives from line 180. Those pulses of fluid are directed into chamber 172 and impinge upon the surfaces of medical instruments mounted on holder 174. The medical instruments within the chamber are cleaned by cavitation from these fluid pulses and the fluid from the pulses outlets through lines 186. Once the cleaning process is complete a hot water rinse may be directed into chamber 172 through line 184 and nozzles 178. Drain 182 may drain the interior of chamber 172.

Figure 12:
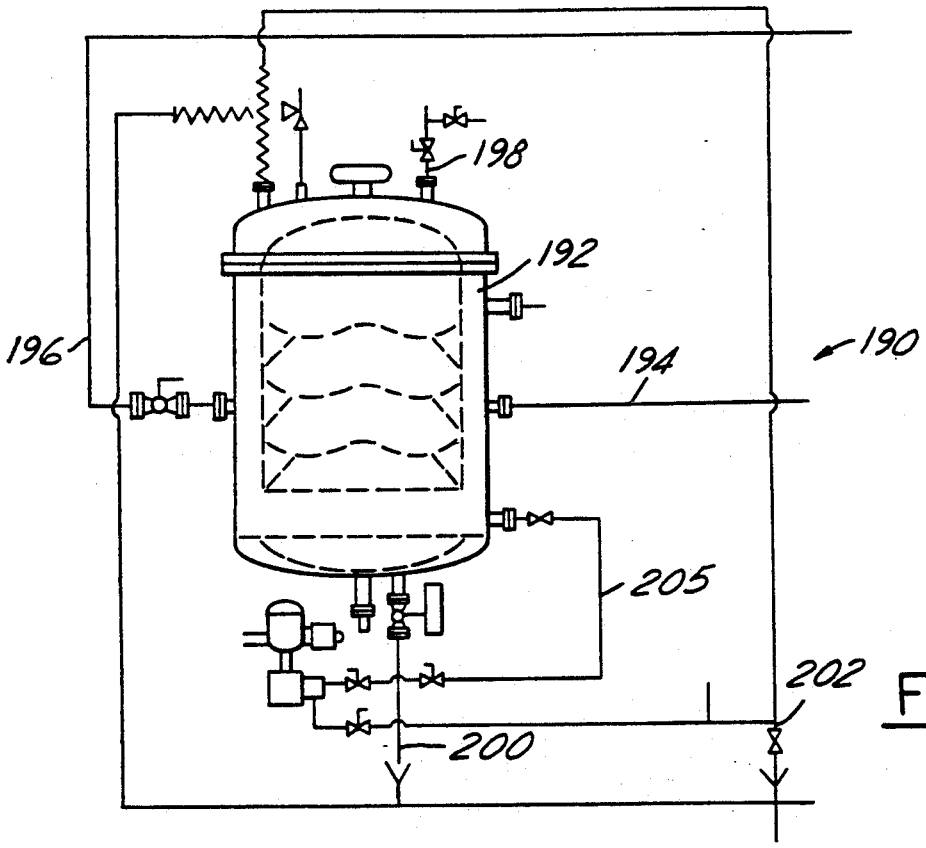
FIG. 12 is a partially schematic view of a clothes washer which utilizes the system of the present invention.

FIG. 12 shows a similar embodiment 190 which is utilized to clean clothing. Outer chamber 192 receives a plurality of clothes to be cleaned. An inlet line 194 is connected to system 20. An outlet line 196 returns to the sump associated with the system of the present invention. Feedback line 198 directs signals back to controller 35 for valve 32. Drain lines 200 and 202 allow draining of chamber 192. Pressurized air is directed into inlet 205 to enhance cavitation.

When it is desired to clean clothing within chamber 192, one directs roiling fluid in through line 194. This roiling or pulsed fluid cleans the clothing within chamber 192 and the fluid outlets through line 196.

Figure 13:
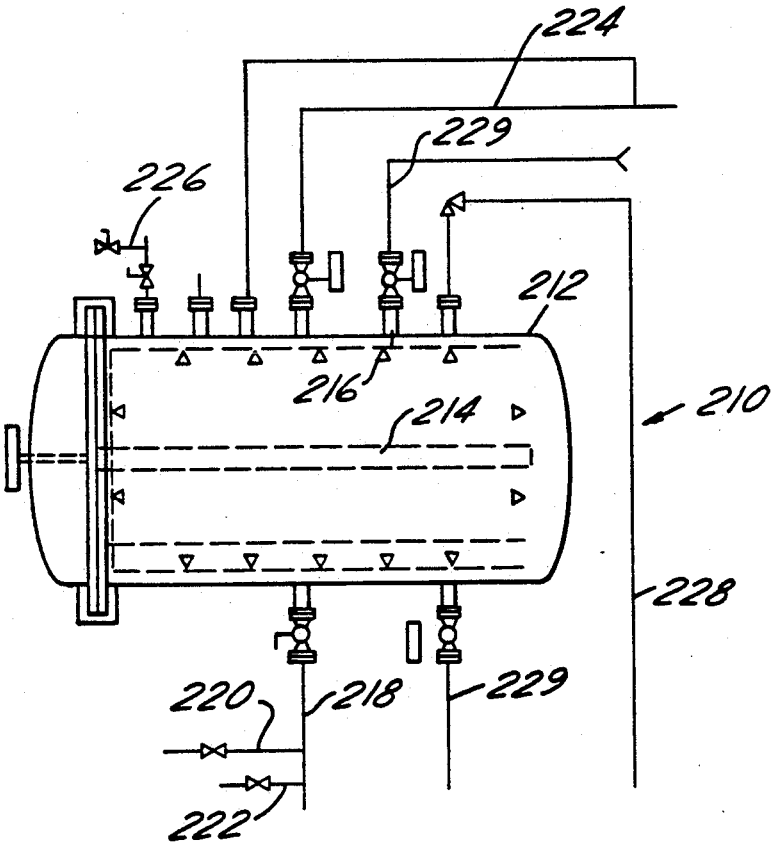
FIG. 13 is a partially schematic view of a dishwasher which utilizes the system of the present invention.

FIG. 13 discloses a dishwasher 210 which is similar to the two previously disclosed embodiments. Chamber 212, which is flooded prior to application of the pulses, contains rack 214 which carries dishes for cleaning. A plurality of nozzles 216 communicate with a rinse water inlet 219. System 20 is connected to inlet 218. Lines 220 and 222 may add additives such as dish soap or other known cleaning ingredients to the cleaning water in line 218. Outlet lines 224 lead from chamber 212. Drain lines 228 and 229 allow draining of chamber 212. Feedback line 226 directs signals back to controller 35 for valve 32.

In the embodiments illustrated in FIGS. 11–13, the "surfaces" to be cleaned are the items, that is the medical instruments, clothes or dishes, placed within the vessels. The systems in FIGS. 12 and 13 would also preferably have pressure indicators and thermal wells.

Figure 14:
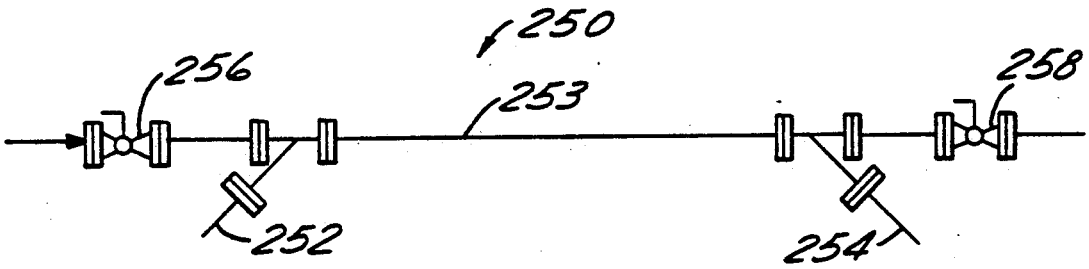
FIG. 14 is a partially schematic view of a pipe section which is cleaned by the system of the present invention.

The modification of system 20 to clean pipe 250 is illustrated in FIG. 14. Inlet 252 is connected at an upstream position of a pipe section 253 while an outlet 254 is connected at a downstream location. On-off valves 256 and 258 isolate this pipe section 253. Pulses of fluid are directed into line 252 and act upon the inner surface of pipe 253, removing any scale. The fluid then leaves through line 254.

Figure 16:
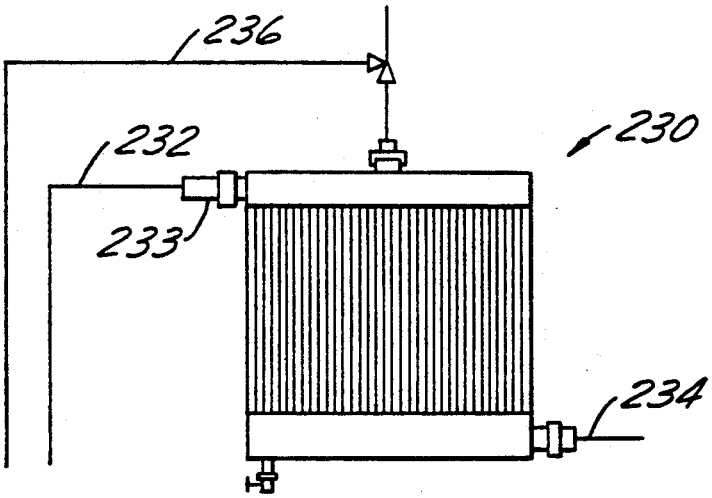
FIG. 16 is a partially schematic view of the connection of the inventive system to a radiator.
Figure 15:
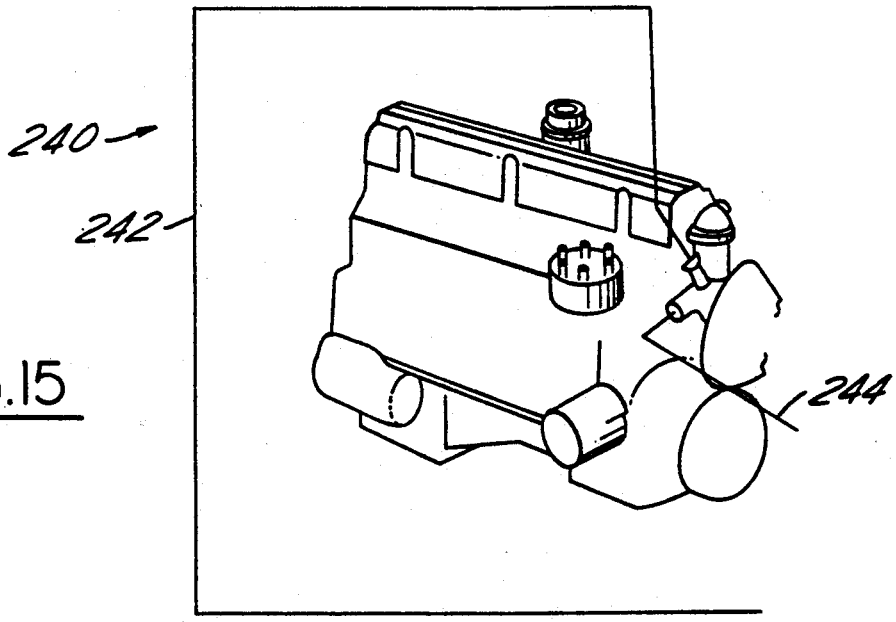
FIG. 15 is a largely schematic view of the connection of the inventive system to an engine.

FIGS. 15 and 16 illustrate the method of the present invention for cleaning automotive components. As shown in FIG. 15, engine 240 has its cooling and heating system cleaned by directing pulses of fluid in through inlet line 254, and out through outlet line 244. A flexible conduit preferably connects inlet 242 to an inlet for the cooling system of engine 240.

As shown in FIG. 16, radiator 230 may also be cleaned by the inventive system. An inlet line 232 is connected through a flexible conduit 233 to the radiator body. An outlet line 234 leads outwardly of the radiator body. A drain line 236 drains the system.

The pulsed fluid is preferably water. It should be understood that the cavitation heats the fluid which is beneficial in the disclosed cleaning operations. Valve 32 may take approximately 1 second to open or close, and preferably remains closed 2 seconds and open 2–3 seconds. These times are approximate and not limiting on this invention. The exact times should be determined experimentally for a particular application. Although several embodiments are not specifically disclosed having a feedback line, it should be understood that each of the systems could be utilized with a feedback line. Further, fluid vessels in the field may be cleaned as is, without any feedback connection. Further, those systems which include dedicated cleaning vessels such as FIG. 11–13 may have interior surfaces lined with a material that prevents abrasion due to the cavitation. The vessels may be lined with styrene-butadiene copolymer, in-situ curved and bonded. Cylinders 106 are preferably of the known type available from Bimba Manufacturing Company of Monee, Ill., and may be Model No. MRS-09-DZ. Typical system pressures are zero to 1600 p.s.i. and are determined experimentally. Flow volumes are on the order of 3 cubic feet per second.

Although preferred embodiments of the present invention have been disclosed, a worker of ordinary skill in the art would recognize that certain modifications would come within the scope of this invention. For that reason, the following claims should be studied in order to determine the true scope and content of this invention.

I claim:

1. A method of cleaning internal surfaces within a vessel comprising the steps of:

(1) cyclically directing pulses of a pressurized fluid into the vessel, such that the pulses impact upon internal surfaces to be cleaned the pulsing of the fluid being created by cyclically operating a valve, and disposing a wave sensor on a fluid line between the valve and the vessel, the wave sensor delivering a feedback signal to a controller for the valve, and controlling the valve in response to the feedback to maintain a desired frequency; and (2) directing the fluid out of the vessel.

2. A method as recited in claim 1, wherein the pulsation of the fluid into the vessel causes cavitation in the fluid.

3. The method as recited in claim 1, wherein the frequency of the cyclical pulses of the fluid into the vessel is controlled, and is greater than 1 per minute.

4. The method as recited in claim 3, wherein a preferred cyclic frequency is determined experimentally.

5. The method as recited in claim 1, wherein a pump pressurizes the fluid and directs it to a valve, and the valve is rapidly opened and closed to create the pulses of fluid.

6. The method as recited in claim 5, wherein a cushioning member is disposed between the pump and the valve to absorb fluid hammers caused when the valve is closed.

7. The method as recited in claim 1, wherein the vessel is normally used for another fluid flow purpose, and the internal surfaces are the internal surfaces of the vessel.

8. The method as recited in claim 7, wherein the vessel is a pipe section.

9. The method as recited in claim 7, wherein the vessel is a condensor, and the surfaces to be cleaned include the surfaces which typically receive a heat exchange fluid.

10. The method as recited in claim 7, wherein the vessel is a heat exchanger, and the surfaces to be cleaned include the process fluid surface which is heated by steam during normal operation of the heat exchanger.

11. The method as recited in claim 7, wherein the vessel is a filter, and the surfaces to be cleaned include the filtering member within the filter.

12. The method as recited in claim 7, wherein the vessel is an automobile component.

13. The method as recited in claim 12, wherein the automotive component is the radiator for the automobile.

14. The method as recited in claim 12, wherein the automotive component is the heating and cooling system of au automobile engine.

15. The method as recited in claim 1, wherein the internal surfaces include items which are placed within the vessel.

16. The method as recited in claim 15, wherein disinfectants inserted into the fluid leading into the vessel to disinfect or clean the items within the vessel.

17. The method as recited in claim 15, wherein medical instruments are placed within the vessel, and are the items which are cleaned.

18. The method as recited in claim 15, wherein clothing is placed within the vessel and are the items which are cleaned.

19. The method as recited in claim 15, wherein dishes are placed within the vessel and are the items which are cleaned.

* * * * *